US007011559B1

(12) United States Patent
Moldenhauer

(10) Patent No.: US 7,011,559 B1
(45) Date of Patent: Mar. 14, 2006

(54) OBSTACLE GUARD FOR A BOAT MOTOR

(76) Inventor: Terry Moldenhauer, N8561 W. Snow Creek Rd., Black River Falls, WI (US) 54615

( * ) Notice: Subject to any disclaimer, the term of this patent is extended or adjusted under 35 U.S.C. 154(b) by 0 days.

(21) Appl. No.: 11/127,553

(22) Filed: May 13, 2005

Related U.S. Application Data

(60) Provisional application No. 60/638,644, filed on Dec. 21, 2004.

(51) Int. Cl.
*B63H 5/16* (2006.01)

(52) U.S. Cl. ..... 440/71; 440/66

(58) Field of Classification Search ..... 440/66, 440/71, 72, 73
See application file for complete search history.

(56) References Cited

U.S. PATENT DOCUMENTS

| | | | | |
|---|---|---|---|---|
| 2,319,640 | A | 5/1943 | Sink | |
| 4,565,533 | A | 1/1986 | Springer | |
| 4,718,871 | A * | 1/1988 | Mendelevitch | 440/71 |
| 4,826,461 | A | 5/1989 | Newman | |
| 5,178,565 | A | 1/1993 | Jacobson | |
| 5,344,346 | A | 9/1994 | Griffin | |
| 5,516,315 | A | 5/1996 | Griffin | |
| 5,664,977 | A | 9/1997 | Dinkowitz et al. | |
| 5,839,929 | A | 11/1998 | Cousins | |
| 6,503,110 | B1 | 1/2003 | Lammli | |

FOREIGN PATENT DOCUMENTS

| | | | |
|---|---|---|---|
| JP | 58116296 | A * | 7/1983 |

* cited by examiner

*Primary Examiner*—Jesus D. Sotelo
(74) *Attorney, Agent, or Firm*—Tipton L. Randall

(57) ABSTRACT

The invention is a lower housing unit and propeller protection assembly for a boat motor. The assembly comprises a planar clamp member, securable to a boat motor upper housing unit. An adjustable length, linear connector member is secured at one end to the clamp member, with the linear connecting member positioned forward of a boat motor lower unit housing and propeller. A propeller and lower unit protection subassembly is secured to the lower unit's skeg and to an end of the linear connector member, which is opposite the clamp member. A reinforcing member is secured to the linear connector member and extends to the lower unit protection subassembly. The protection assembly transfers impact force on the subassembly and reinforcing member to the clamp member.

22 Claims, 6 Drawing Sheets

OBSTACLE GUARD FOR A BOAT MOTOR

CROSS-REFERENCE TO RELATED APPLICATIONS, IF ANY

This application claims the benefit under 35 U.S.C. §119 (e) of co-pending provisional application Ser. No. 60/638,644, filed 21 Dec., 2004. Application Ser. No. 60/638,644 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to an obstacle guard for a boat motor and, more particularly, to an attachable obstacle guard for a boat motor and, most particularly, to an adjustable obstacle guard fitting various sized boat motors for such use.

2. Background Information

A variety of designs are used for motors which attach to a boat to provide propulsion. Nearly all motors use internal combustion engines as the power source to rotate one or more propellers below water level to move the boat. The most popular motor designs include the outboard motor which removably attaches to the rear or transom of the boat. A housing supports the internal combustion motor at one end, with the propeller, or "prop," mounted at the opposite end of the housing, below water level. Various drive shafts and gearing are located within the housing to deliver torque from the motor to the propeller. The housing of the boat motor is usually designated as having an upper housing unit, containing a drive shaft connected to the engine, and a lower housing unit, containing a gear assembly and for mounting the propeller. The upper and lower housing units are joined together by bolted flanges for ease of manufacture and servicing. The lower housing unit also includes an external, horizontal cavitation plate above the propeller and an external, vertical skeg or fin extending vertically, below the propeller. Outboard motors range in size from two horse power to several hundred horse power, with an accompanying increase in size and weight. Such outboard motors are designed to pivot at the point of attachment to the transom, in the event the lower unit encounters underwater obstacles while the boat and motor are moving. Collision of the motor's lower unit and propeller with such obstacles, particularly at high speed, can result in costly damage to either or both of these components of the outboard motor.

Another motor design is the so called "inboard/outboard" (I/O) propulsion unit which includes an internal combustion engine mounted interior the boat (the inboard portion), and a stern drive unit with a propeller (the outboard portion), mounted to a gimble in the rear or transom of the boat. The I/O stern drive unit also contains an upper housing unit containing a drive shaft connected to the engine, and a lower housing unit containing a gear assembly and for mounting the propeller. The upper and lower housing units of the stern drive unit are joined together by bolted flanges for ease of manufacture and servicing. The lower unit likewise includes a horizontal cavitation plate above the propeller and a vertical skeg or fin extending below the propeller. A waterproof seal is attached between the gimbal and transom to prevent water from entering the boat around the gimbal. The I/O units are quite powerful and used to propel larger boats at high rates of speed. Again, collision of the I/O motor's lower unit and propeller with underwater obstacles, particularly at high speed, can result in costly damage to either or both of these components of the I/O propulsion system.

Various guard systems have been devised to protect outboard motors and I/O units from damage caused by collision with underwater obstacles. Patents have been granted for several of these invention, including the following: U.S. Pat. No. 2,319,640 by Sink; U.S. Pat. No. 4,565,533 by Springer; U.S. Pat. No. 4,826,461 by Newman; U.S. Pat. No. 5,178,565 by Jacobson; U.S. Pat. Nos. 5,344,346 and 5,515,315 by Griffin; U.S. Pat. No. 5,664,977 by Dinkowitz et al.; U.S. Pat. No. 5,839,929 by Cousins; and U.S. Pat. No. 6,503,110 by Lammli.

The existing motor guards in this technology include various limitations, including that various sizes and models of boat motors each require a guard specifically designed for that size and/or model of boat motor. Applicant has devised a universally adjustable motor guard device that can be used with a wide range of boat motor sizes and/or models.

SUMMARY OF THE INVENTION

The invention is directed to a lower housing unit and propeller protection assembly for a boat motor. The assembly comprises a planar clamp member securable to a boat motor upper housing unit. An adjustable length, linear connector member is secured at one end to the clamp member, with the linear connecting member positioned forward of a boat motor lower unit housing and propeller. A propeller and lower unit protection subassembly is secured to a lower unit skeg and to an end of the linear connector member opposite the clamp member. The subassembly includes an anchoring member having a skeg-accepting channel therein. The anchoring member includes an aperture there through adapted for securing a skeg within the skeg-accepting channel. A pair of first planar fin members is secured to the anchoring member and extends in a V-shape from the anchoring member adjacent the skeg-accepting channel, with each first fin member extending beyond an outer circumference of the motor propeller. A pair of second planar fin members is secured to the anchoring member and extends in a V-shape from the anchoring member adjacent the skeg-accepting channel, with each second fin member positioned in register above a first fin member and secured by a bent end at a second fin member end opposite the anchoring member to a first fin member. A connector tab is secured at a first end within the skeg-accepting channel and to the linear connector member at a connector tab second end. A reinforcing member is secured at a first end to the linear connector member and extends into the skeg-accepting channel of the anchoring member of the propeller and lower housing unit protection subassembly. The protection assembly transfers impact force on the subassembly and reinforcing member to the clamp member secured to the upper housing unit.

DESCRIPTION OF THE EMBODIMENTS

Nomenclature

Figure 1:
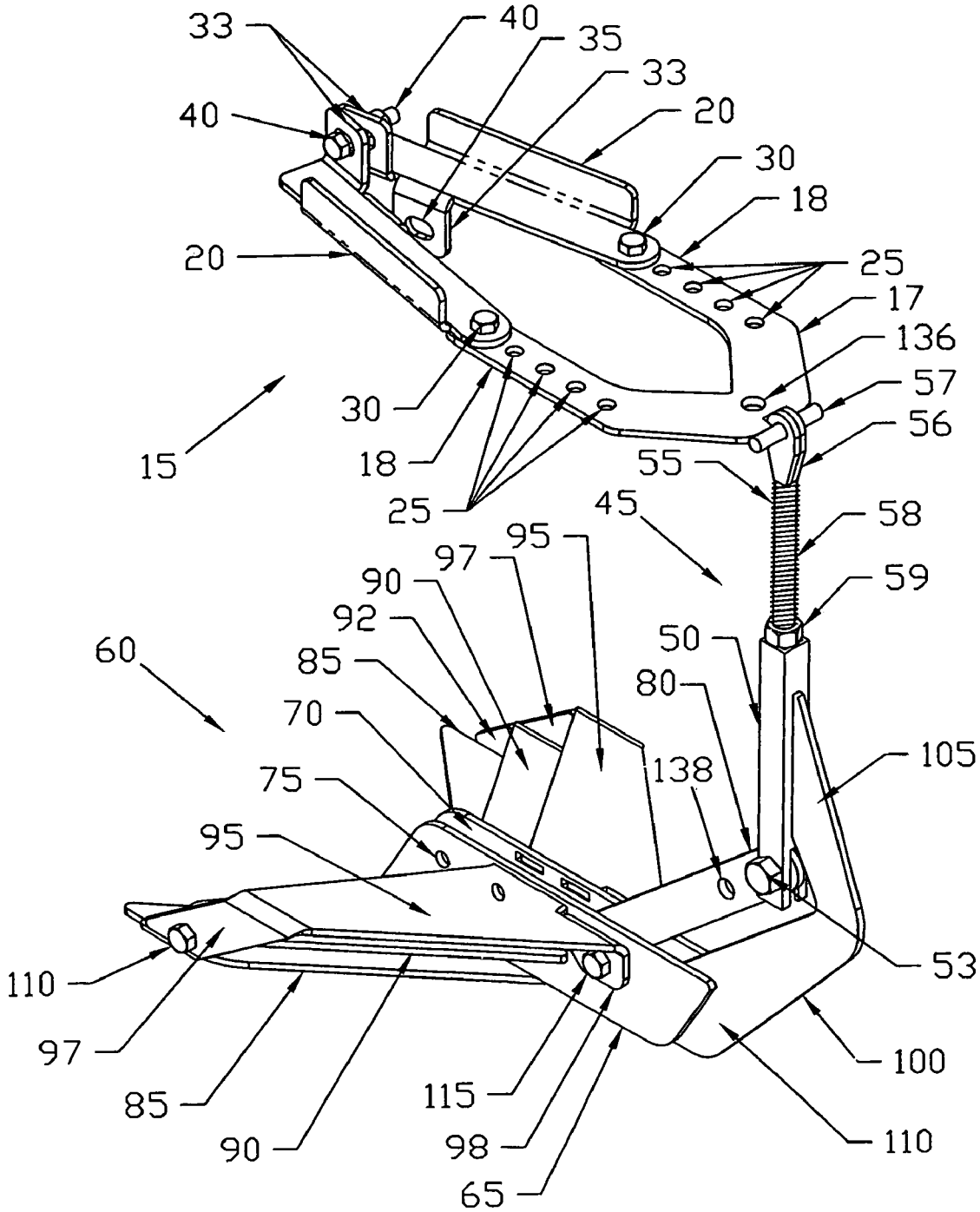
FIG. 1 is a perceptive view of the lower housing unit and propeller protection assembly of the present invention.

10 Lower Housing and Propeller Protection Assembly
15 Planar Clamp Member
17 U-shaped Portion of Clamp Member
18 Legs of U-shaped Portion
20 Arm Portions of Clamp Member
22 Apertures in Arm Portions
25 Apertures in U-shaped Portion
30 Bolt and Nut Fastener Member
33 Tabs of Arm Portions
35 Tab Eye Holes
40 Bolt and Nut Fastener Member
45 Linear Connector Member
50 Hollow Outer Section
51 Slot in Outer Section
52 Bolt Apertures in Outer Section
53 Bolt and Nut Fastener Member
55 Solid Cylindrical Inner Section
56 Upper End Connector
57 Pivot Pin Member
58 Threaded Lower Portion of Inner Section
59 Nut Member
60 Propeller and Lower Housing Unit Protection Subassembly
65 Anchoring Member
70 Skeg Channel in Anchoring Member
75 Apertures in Anchoring Member
80 Connector Tab of Anchoring Member
85 First Fin Members
90 Second Fin Members
92 Bent End Section of Second Fin Member
93 Eye Hole in Bent End Section
95 Third Fin Member
97 Bent End Section of Third Fin Member
98 Tab of Third Fin Member
99 Eye Hole in Tab of Third Fin Member
99*a* Hole in Bent End Section of Third Fin Member
100 Planar V-Shaped Reinforcing Member
105 First End of Reinforcing Member
110 Second End of Reinforcing Member
115 Bolt and Nut Fastener Member
120 Bolt and Nut Fastener Member
130 Reinforcing Rod Member
132 First End of Rod Member
134 Second End of Rod Member
136 Aperture in U-shaped Portion of Clamp Member
138 Aperture in Connector Tab
140 Lock Nut Members
C Cavitation Plate
E Exhaust Port
H Boat Motor Housing
L Lower Housing Unit
P Propeller
S Skeg
U Upper Housing Unit
W Water Intake Port Construction The invention is a lower housing unit and propeller protection assembly for a boat motor. The assembly comprises a planar clamp member securable to a boat motor upper housing unit. An adjustable length, linear connector member is secured at one end to the clamp member, with the linear connecting member positioned forward of a boat motor lower unit housing and propeller. A propeller and lower unit protection subassembly is secured to a lower unit skeg and to an end of the linear connector member opposite the clamp member. The subassembly includes an anchoring member, having a skeg-accepting channel therein, and a pair of first planar fin members, extending in a V-shape from the anchoring member adjacent the lower housing unit skeg, with each first fin member extending beyond an outer circumference of the motor propeller. A pair of second planar fin members is secured to the anchoring member adjacent the lower housing unit skeg, with each second fin member positioned in register above a first fin member and secured by a bent end at a second fin member end opposite the anchoring member. A connector tab is secured at a first end within the skeg-accepting channel and to the linear connector member at a connector tab second end. A reinforcing member is secured at a first end to the linear connector member and extends into the skeg-accepting channel of the anchoring member of the propeller and lower housing unit protection subassembly. The protection assembly transfers impact force on the subassembly and reinforcing member to the clamp member secured to the upper housing unit.

Figure 2:
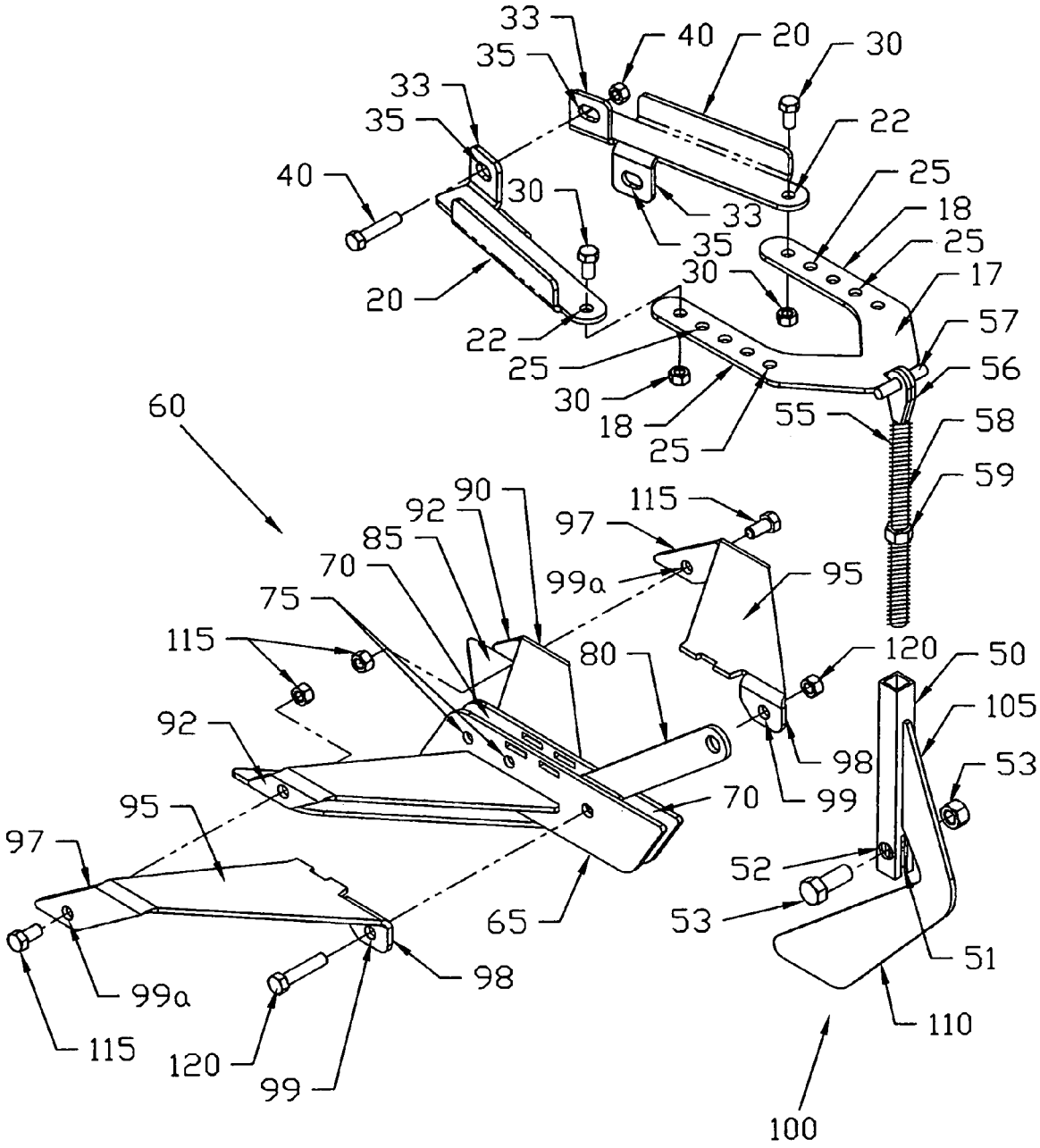
FIG. 2 is an exploded view of the lower housing unit and propeller protection assembly of the present invention.

Referring now to FIGS. 1 and 2, several views of the lower housing unit and propeller protection assembly 10 of the present invention are shown. The assembly 10 includes a planar clamp member 15 securable to a boat motor upper housing unit U. The clamp member 15, shown in FIGS. 1 and 2, includes a U-shaped portion 17 secured to arm portions 20 at an end of each leg 18 of the U-shaped portion 17. Each arm portion 20 includes a bolt aperture at one end. The legs 18 each include a plurality of apertures 25, used for adjustably securing one arm portion 20 to each leg 18 with bolt and nut fastener members 30. The apertures 25 in the legs 18 allow the arm portions 20 of the clamp member 15 to be lengthened or shortened by varying the overlap of the arm portions 20 with the legs 18 to accommodate various sized boat motor upper housing units U. The arm portions 20 also allow the clamp member 15 to conform to the upper housing units U of motors of various thickness. Each end of the arm portions 20 opposite the U-shaped portion 17 includes at least one tab 33 having an eye hole 35. In the embodiment shown in FIGS. 1 and 2, each arm portion 20 includes two tabs 33 with eye holes 35 to accommodate various sized upper housing units U. Thus, the clamp member 15 is securable to a boat motor's upper housing unit U by a threaded bolt and nut member 40. The threaded bolt portion is inserted through the aligned eye holes 35 of each arm portion 20, and the nut portion is rotated on the bolt portion to draw the tabs 33 of each arm portion 20 toward each other, as illustrated in FIGS. 1 and 3–5. The bolt and nut member 40 also can be varied in size to accommodate upper housing units U of various thickness and securely fasten the lower housing unit and propeller protection assembly 10 to the upper housing unit U without modifying the upper housing unit U or using screws or bolts from the upper housing unit U to secure the clamp member 15.

The clamp member 15 is pivotally joined to an adjustable length, linear connector member 45, with the linear connecting member 45 positioned in alignment and forward of a boat motor's lower unit housing L and propeller P. Preferably, the linear connector member 45 includes a hollow, outer section 50 housing a cylindrical, solid inner section 55, thereby allowing adjustment of the length of the connector member 45 by sliding movement between the outer section 50 and inner section 55. Although the connector member 45 is illustrated with the hollow, outer section 50 attached to the subassembly 60 and the cylindrical solid inner section 55 attached to the clamp member 15, the inner section 55 may be attached to the subassembly 60 and the hollow outer section 50 attached to the clamp member 15 with equivalent results.

The cylindrical, solid inner section 55 includes an upper end connector 56 attached to a pivot pin member 57 rigidly secured to the clamp member 15, providing pivoting movement of the inner section 55 relative to the clamp member 15. The inner section 55 also includes a threaded lower portion 58 that fits slidably within the outer section 50. A nut member 59 is moveable on the threaded lower portion 58 and positioned exterior the outer section 50. The hollow outer section 50 of the linear connector member 45 includes a slot 51 at an end opposite the clamp member 15, with a bolt aperture 52 for securing the connector tab 80 within the slot 51 by means of a nut and bolt member 53 inserted through the bolt aperture 52.

A propeller and lower unit protection subassembly 60 is secured to the skeg S of the boat motor's lower housing unit L and to an end of the linear connector member 45 opposite the clamp member 15 by the connector tab 80. The subassembly 60 includes an anchoring member 65 having a skeg-accepting channel 70 therein. The anchoring member 65 includes at least one aperture 75 for securing the subassembly 60 to the skeg S and a tab portion 80 for connection with the outer section 50 of the linear connector member 45. The two skeg attachment apertures 75 of the anchoring member 65 are best seen in FIG. 2. Once the protection assembly 10 is fitted to a boat motor, a hole is drilled through the skeg S and a threaded fastener, or a similar connector, inserted through the aperture 75, and the skeg S secures the anchoring member 65 thereto. The skeg S is of a solid material, such as cast aluminum, and drilling a hole through the solid skeg S does not affect the integrity of the lower unit L of the boat motor. The anchoring member's channel 70 is open toward the rear of the subassembly 60, allowing the skeg S to extend rearward as far as necessary. This feature allows the subassembly 60 to fit boat motors of a wide range of sizes.

Figure 4:
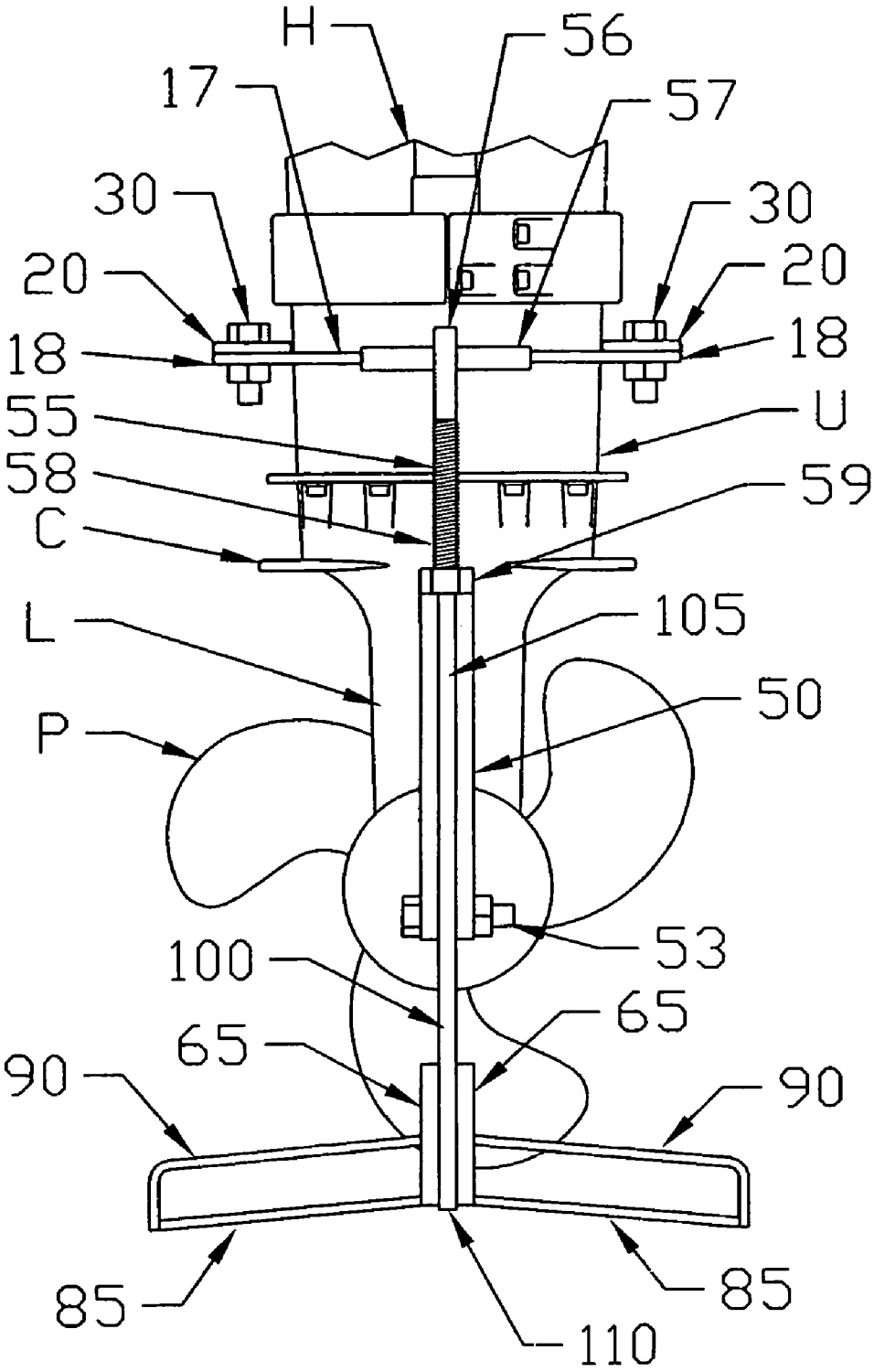
FIG. 4 is a front view of the lower housing unit and propeller protection assembly of the present invention secured to an outboard motor.
Figure 5:
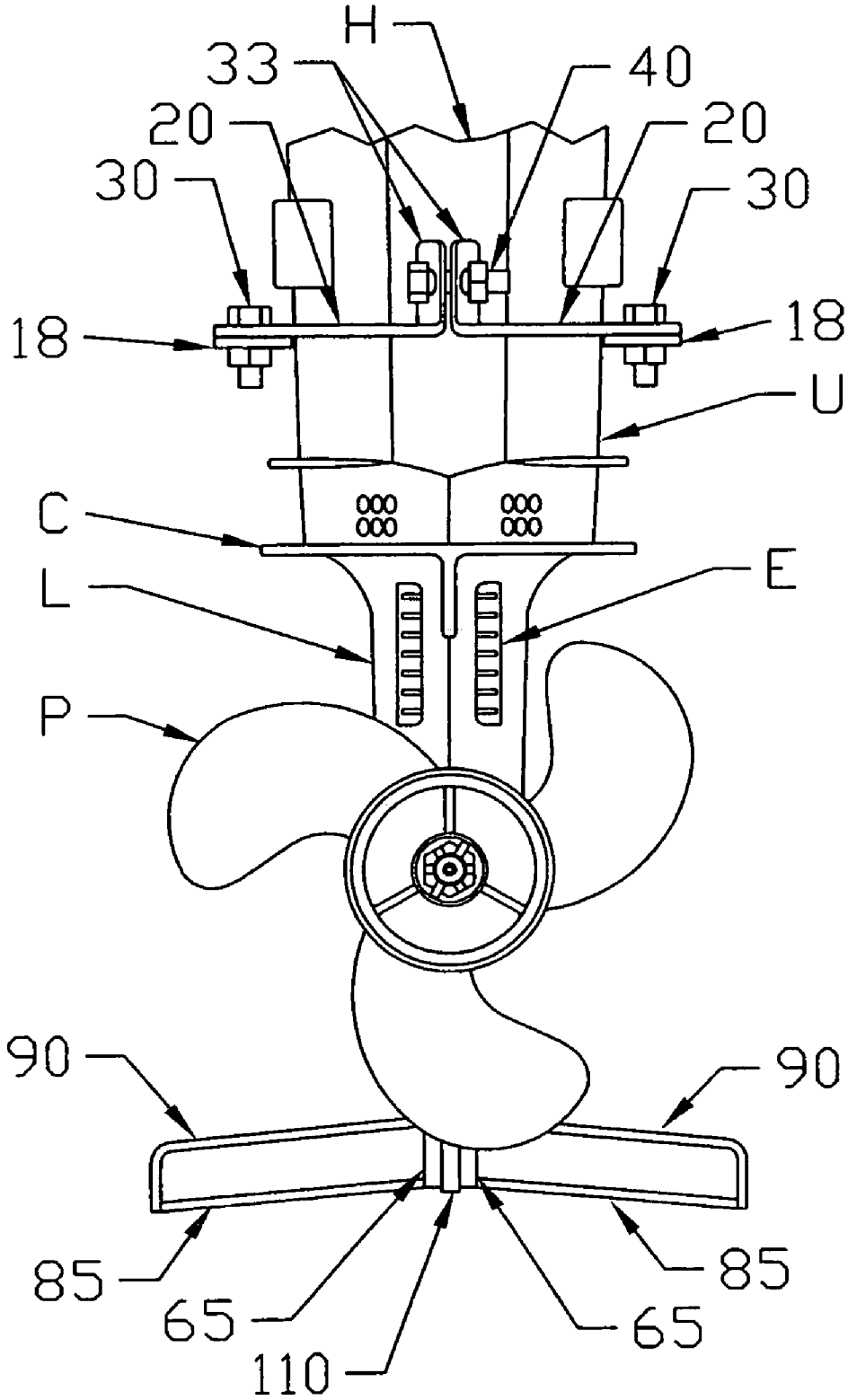
FIG. 5 is a rear view of the lower housing unit and propeller protection assembly of the present invention secured to an outboard motor.

Referring again to FIGS. 1 and 2, a pair of first planar fin members 85 extend in a V-shape from the anchoring member 65 adjacent to the lower unit's skeg S, with each first fin member 85 extending beyond an outer circumference of the motor propeller P. A pair of second planar fin members 90 is also secured to the anchoring member 65 adjacent to the lower unit's skeg S. Each second fin member 90 is positioned in register above a first fin member 85 and secured by a bent end section 92 at a second fin member end, opposite the anchoring member 65, to the first fin member 85. The embodiment of the invention with pairs of first and second fin members 85, 90 is employed for smaller outboard motors and illustrated in FIGS. 3–5. The protective coverage provided for the propeller P and boat motor's lower housing unit U by the subassembly 60 is best seen in FIG. 5, which shows a view from the rear of an outboard motor fitted with the lower housing unit and propeller protection assembly 10 of the present invention.

In a further embodiment of the invention, a third pair of fin members 95 is secured to the anchoring member 65 adjacent to the lower unit's skeg S. Each third fin member 95 is positioned in register above a second fin member 90 and secured by a bent end section 97 at a third fin member end, opposite the anchoring member 65, to the second fin member 90. The third fin member 95 includes a tab 98 with an aperture 99 for attaching the pair of third fin members 95 to the anchoring member 65 with a nut and bolt member 120. The bent end section 97 at a third fin member end includes an aperture 99*a* matching an aperture in the bent end section 92 at a second fin member end, with a nut and bolt member 115 securing the two bent end sections 92, 97 together to provide a stronger subassembly 60, which is useful for larger outboard motors and I/O stern drive units.

Figure 3:
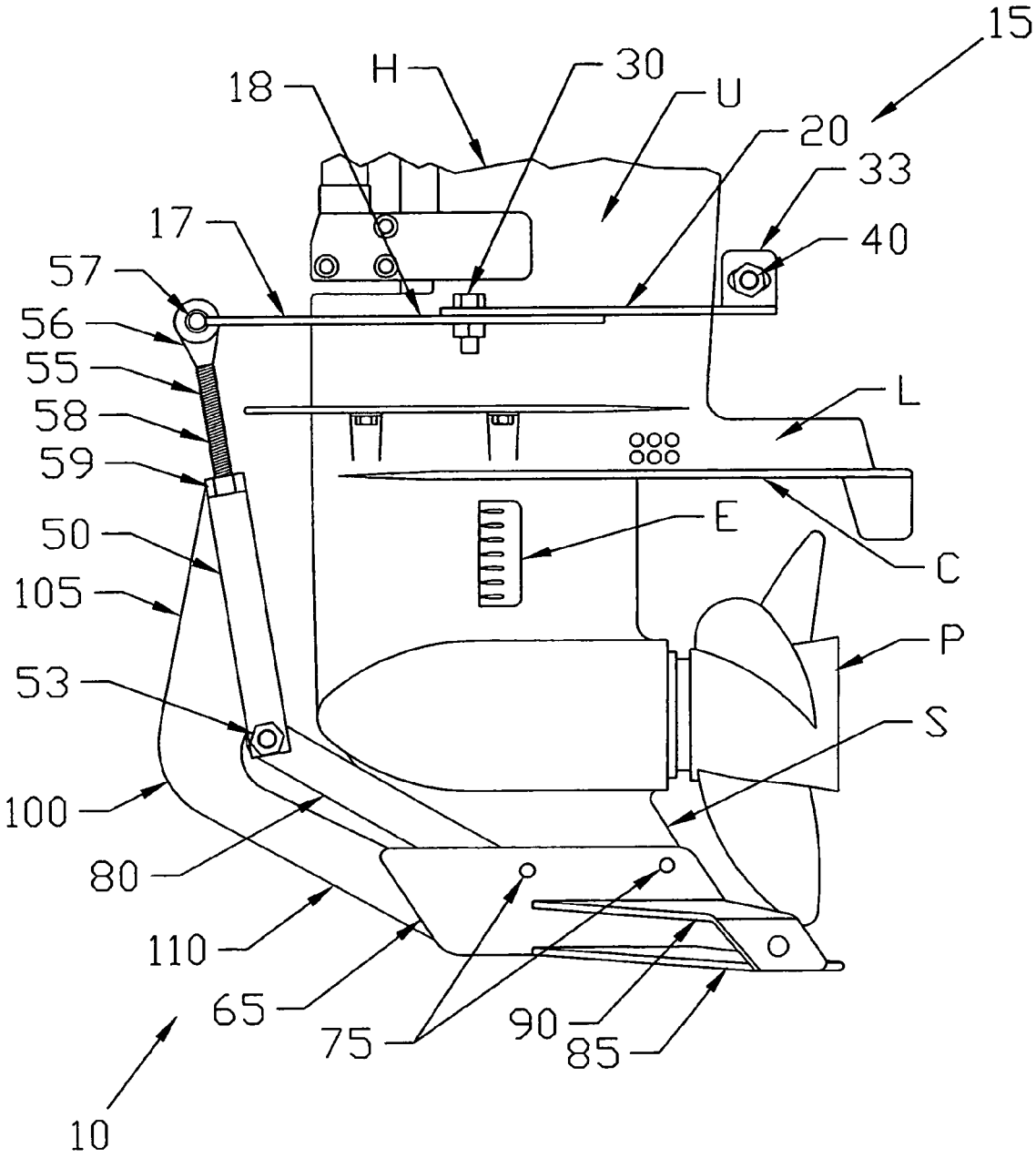
FIG. 3 is a side view of the lower housing unit and propeller protection assembly of the present invention secured to an outboard motor.

A reinforcing member 100 is secured to the hollow outer section 50 of the linear connector member 45 to transfer impact force on the subassembly 60 and reinforcing member 100 to the clamp member 15. The reinforcing member 100 is planar and V-shaped, with a first end 105 rigidly secured to the hollow outer section 50 of the linear connector member 45. The lower, second end 110 of the reinforcing member 100 fits into the front end of the skeg channel 70 of the anchoring member 65. The reinforcing member 100 is best seen in FIGS. 3–5, where the protection assembly 10 is shown secured to an outboard motor. Most preferably, the reinforcing member 100 comprises a planar, V-shaped reinforcing member 100, secured along a first end 105 to the adjustable length, linear connector member 45. The planar, V-shaped reinforcing member 100 is oriented parallel with the skeg-accepting channel 70 and, thus, the skeg S of the motor's lower unit L. The V-shaped reinforcing member 100 includes a second end portion 110 angled toward and extending into the skeg-accepting channel 70. Thus, the reinforcing member 100 is usually the first element to contact an underwater obstacle as the boat motor moves forward in the water. A tight connection between the hollow, outer section 50 and the cylindrical, solid inner section 55 of the connector member 45 is achieved by advancing the nut 59 down the threaded portion 58 of the inner section 55 to contact the top of the outer section 50, once the assembly 10 is secured to a boat motor.

Figure 6:
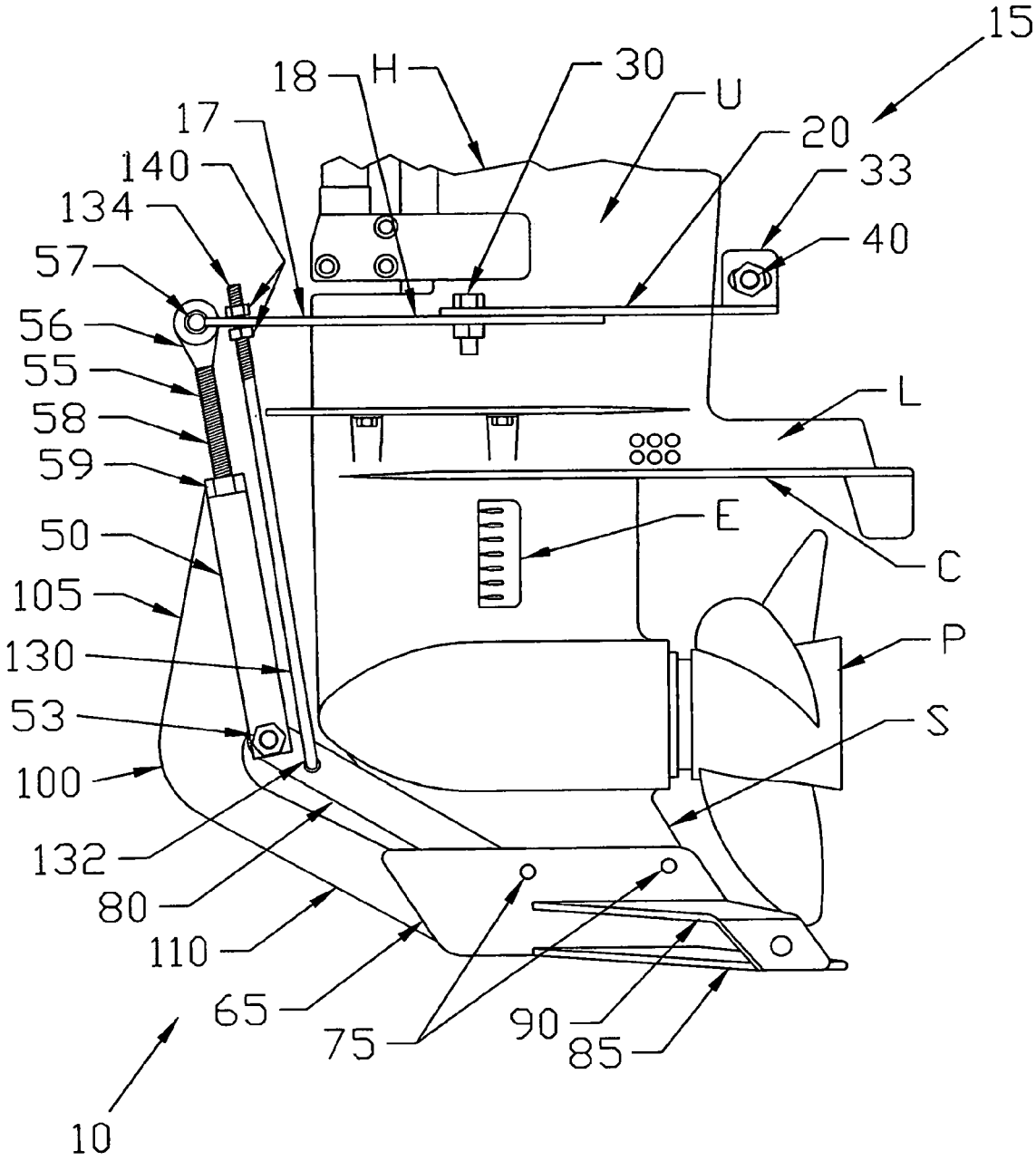
FIG. 6 is a side view of a further embodiment of the lower housing unit and propeller protection assembly of the present invention secured to an outboard motor.

Referring now to FIG. 6, a further embodiment of the lower housing unit and propeller protection assembly 10 of the present invention is shown. In this further embodiment, an additional reinforcing rod member 130 is secured between the U-shaped portion 17 of the planar clamp member 15 and the connector tab 80 of the anchoring member 65. The reinforcing rod member 130 is secured at a first end 132 to the connector tab 80 adjacent the attached hollow outer section 50 of the linear connector member 45, and at a second end 134 to the U-shaped portion 17 of the planar clamp member 15 adjacent the pivot pin member 57. The reinforcing rod member 130 lies parallel and directly behind the linear connector member 45, as illustrated in FIG. 6. The first end 132 of the reinforcing rod member 130 includes, for example, a right angle bend and a mushroom end to retain the first end 132 in an aperture 138 in the connector tab 80, while allowing the reinforcing rod member 130 to extend vertically therefrom. To facilitate installation of the reinforcing rod member 130, the U-shaped portion 17 of the planar clamp member 15 includes an aperture 136 for insertion of the second end 134 thereof. The second end 134 of the reinforcing rod member 130 preferably is threaded, such that a pair of lock nut members 140 on the second end 134 can be positioned and tightened, with one lock nut member 140 on each side of the U-shaped portion 17 of the planar clamp member 15. The reinforcing rod member 130 assists in transferring impact force on the subassembly 60 and the reinforcing member 100 to the clamp member 15 secured to the upper housing unit U.

The planar structure of the clamp member 15 allows the lower housing unit and propeller protection assembly 10 to be secured to the lower housing unit U of a stern driven I/O boat motor. Often, such lower housing units U include several sets of stabilizer fins, in addition to the cavitation plate C found on nearly all boat motors. The lower housing unit and propeller protection assembly 10 of the present invention does not interfere with the exhaust port E or the water intake port W of the lower housing unit L of either outboard motors or stern driven I/O motors. The clamp member 15 does not require disturbance of the structural integrity of the upper housing unit U of boat motors, either outboard or I/O stern drive systems, when attaching the clamp member 15 to the boat motor. Thus, the protection assembly 10 can be readily installed and removed with minimal disturbance of the boat motor. The aperture required in the motor's skeg S for securing the anchoring member 65 thereto does not interfere with the functioning of the skeg S or the boat motor, as a whole.

The lower housing unit and propeller protection assembly 10 of the present invention is preferably fabricated from a corrosion-resistant alloy, such as stainless steel, for durability and strength. The assembly 10 can be painted to match the color of the boat motor housing H for aesthetic purposes.

While the invention has been particularly shown and described with reference to preferred embodiments thereof, it will be understood by those skilled in the art that various changes in form and details may be made therein without departing from the spirit and scope of the invention.

I claim:

1. A lower housing unit and propeller protection assembly adapted for a boat motor comprising:

a planar clamp member adapted for securing to a boat motor upper housing unit;

an adjustable length, linear connector member secured at one end to the clamp member, the linear connecting member adapted for positioning forward of a boat motor lower housing unit and propeller;

a propeller and lower housing unit protection subassembly secured to an end of the linear connector member opposite the clamp member and adapted for securing to a lower housing unit skeg, the subassembly including an anchoring member having a skeg-accepting channel therein, the anchoring member including an aperture there through adapted for securing a skeg within the skeg-accepting channel, a pair of first planar fin members extending in a V-shape from the anchoring member adjacent the skeg-accepting channel, each first fin member adapted for extending beyond an outer circumference of the motor propeller, a pair of second planar fin members secured to the anchoring member adjacent the skeg-accepting channel, each second fin member positioned in register above a first fin member and secured by a bent end at a second fin member end opposite the anchoring member to a first fin member;

a connector tab secured at a first end within the skeg-accepting channel and to the linear connector member at a connector tab second end; and a reinforcing member secured at a first end to the linear connector member and extending into the skeg-accepting channel of the anchoring member of the propeller and lower housing unit protection subassembly, the protection assembly transferring impact force on the lower housing unit protection subassembly and reinforcing member to the clamp member adapted for securing to the upper housing unit.

2. The lower housing unit and propeller protection assembly adapted for a boat motor according to claim 1, wherein the planar clamp member includes a U-shaped portion with leg sections, each leg section adjustably fastened to a first end of an arm section, the arm sections joined together at a second end thereof.

3. The lower housing unit and propeller protection assembly adapted for a boat motor according to claim 2, wherein each leg section and arm section are adjustably joined in overlapping relationship, the arm section adjustable in length by adjusting the degree of overlap between the leg section and arm section.

4. The lower housing unit and propeller protection assembly for adapted a boat motor according to claim 3, wherein the U-shaped portion's leg sections include apertures for threaded fasteners for adjusting the degree of overlapping between the leg sections and arm sections.

5. The lower housing unit and propeller protection assembly adapted for a boat motor according to claim 2, wherein each arm section's second end includes at least one tab perpendicular to the planar clamp member with an aperture therein, and a threaded fastener and nut inserted through each aperture for adjustably joining together the second end of each arm section.

6. The lower housing unit and propeller protection assembly adapted for a boat motor according to claim 2, wherein the adjustable length, linear connector member is secured at one end to the clamp member by a connector pivotally secured to a pivot pin member rigidly fastened to the U-shaped portion of the clamp member.

7. The lower housing unit and propeller protection assembly adapted for a boat motor according to claim 1, wherein the linear connector member includes an outer section housing a cylindrical solid inner section, thereby allowing adjustment of the length of the connector member by sliding movement between the outer section and inner section.

8. The lower housing unit and propeller protection assembly adapted for a boat motor according to claim 7, wherein the linear connector member's solid inner section is secured to the planar clamp member and the linear connector member's outer section is secured to the propeller and lower housing unit protection subassembly.

9. The lower housing unit and propeller protection assembly adapted for a boat motor according to claim 7, wherein the linear connector member's outer section is secured to the planar clamp member and the linear connector member's cylindrical solid inner section is secured to the propeller and lower housing unit protection subassembly.

10. The lower housing unit and propeller protection assembly adapted for a boat motor according to claim 1, further including a pair of third planar fin members secured to the anchoring member adjacent the skeg-accepting channel, each third fin member positioned in register above a second fin member and secured by a bent end at a third fin member end opposite the anchoring member to a second fin member.

11. The lower housing unit and propeller protection assembly adapted for a boat motor according to claim 1, wherein the reinforcing member includes a planar, V-shaped member secured along a first end to the adjustable length, linear connector member and having a planar second end positioned within the skeg-accepting channel of the anchoring member.

12. A lower housing unit and propeller protection assembly adapted for a boat motor comprising:

a planar clamp member adapted for securing to a boat motor upper housing unit, the planar clamp member including a U-shaped portion with leg sections, each leg section adjustably fastened to a first end of an arm section, the arm sections joined together at a second end thereof;

an adjustable length, linear connector member secured at one end to the clamp member by a connector pivotally secured to a pivot pin member rigidly fastened to the U-shaped portion of the clamp member, the linear connecting member adapted for positioning forward of a boat motor lower housing unit and propeller;

a propeller and lower housing unit protection subassembly secured to an end of the linear connector member opposite the clamp member and adapted for securing to a lower housing unit skeg, the subassembly including an anchoring member having a skeg-accepting channel therein, the anchoring member including an aperture there through adapted for securing a skeg within the skeg-accepting channel, a pair of first planar fin members extending in a V-shape from the anchoring member adjacent the skeg-accepting channel, each first fin member adapted for extending beyond an outer circumference of the motor propeller, a pair of second planar fin members secured to the anchoring member adjacent the skeg-accepting channel, each second fin member positioned in register above a first fin member and secured by a bent end at a second fin member end opposite the anchoring member;

a connector tab secured at a first end within the skeg-accepting channel and to the linear connector member at a connector tab second end; and a reinforcing member secured at a first end to the linear connector member and extending into the skeg-accepting channel of the anchoring member of the propeller and lower housing unit protection subassembly, the protection assembly transferring impact force on the lower housing unit protection subassembly and reinforcing member to the clamp member adapted for securing to the upper housing unit.

13. The lower housing unit and propeller protection assembly adapted for a boat motor according to claim 12, wherein each leg section and arm section is adjustably joined in overlapping relationship, the arm section adjustable in length by adjusting the degree of overlap between the leg section and arm section.

14. The lower housing unit and propeller protection assembly adapted for a boat motor according to claim 13, wherein the U-shaped portion's leg sections include apertures for threaded fasteners for adjusting the degree of overlapping between the leg sections and arm sections.

15. The lower housing unit and propeller protection assembly adapted for a boat motor according to claim 12, wherein each arm section's second end includes at least one tab perpendicular to the planar clamp member with an aperture therein, and a threaded fastener and nut inserted through each aperture for adjustably joining together the second end of each arm section.

16. The lower housing unit and propeller protection assembly adapted for a boat motor according to claim 12, wherein the linear connector member includes an outer section housing a cylindrical solid inner section, thereby allowing adjustment of the length of the connector member by sliding movement between the outer section and inner section.

17. The lower housing unit and propeller protection assembly adapted for a boat motor according to claim 16, wherein the linear connector member's solid inner section is secured to the planar clamp member and the linear connector member's outer section is secured to the propeller and lower housing unit protection subassembly.

18. The lower housing unit and propeller protection assembly adapted for a boat motor according to claim 16, wherein the linear connector member's outer section is secured to the planar clamp member and the linear connector member's cylindrical solid inner section is secured to the propeller and lower housing unit protection subassembly.

19. The lower housing unit and propeller protection assembly adapted for a boat motor according to claim 12, further including a reinforcing rod member secured at a first end to the connector tab of the propeller and lower housing unit protection subassembly adjacent the linear connector member secured thereto, and secured at a second end to the U-shaped portion of the clamp member adjacent the pivot pin member securing the linear connector member thereto.

20. A lower housing unit and propeller protection assembly adapted for a boat motor comprising:

a planar clamp member adapted for securing to a boat motor upper housing unit, the planar clamp member including a U-shaped portion with leg sections, each leg section adjustably fastened to a first end of an arm section, the arm sections joined together at a second end thereof;

an adjustable length, linear connector member including an outer section housing a cylindrical solid inner section secured at one end to the clamp member by a connector pivotally secured to a pivot pin member rigidly fastened to the U-shaped portion of the clamp member, the linear connecting member adapted for positioning forward of a boat motor lower housing unit and propeller;

a propeller and lower housing unit protection subassembly secured to an end of the linear connector member opposite the clamp member and adapted for securing to a lower housing unit skeg, the subassembly including an anchoring member having a skeg-accepting channel therein, the anchoring member including an aperture there through adapted for securing a skeg within the skeg-accepting channel, a pair of first planar fin members extending in a V-shape from the anchoring member adjacent the skeg-accepting channel, each first fin member extending beyond an outer circumference of the motor propeller, a pair of second planar fin members secured in a V-shape from the anchoring member adjacent the skeg-accepting channel, each second fin member positioned in register above a first fin member and secured by a bent end at a second fin member end opposite the anchoring member, a pair of third planar fin members secured to the anchoring member adjacent the skeg-accepting channel, each third fin member positioned in register above a second fin member and secured by a bent end at a third fin member end opposite the anchoring member to a second fin member;

a connector tab secured at a first end within the skeg-accepting channel and to the linear connector member at a connector tab second end; and a reinforcing member secured at a first end to the linear connector member and extending into the skeg-accepting channel of the anchoring member of the propeller and lower housing unit protection subassembly, the protection assembly transferring impact force on the lower housing unit protection subassembly and reinforcing member to the clamp member adapted for securing to the upper housing unit.

21. The lower housing unit and propeller protection assembly adapted for a boat motor according to claim 20, wherein the reinforcing member includes a planar, V-shaped member secured along a first end to the adjustable length, linear connector member and having a planar second end positioned within the skeg-accepting channel of the anchoring member.

22. The lower housing unit and propeller protection assembly adapted for a boat motor according to claim 20, further including a reinforcing rod member secured at a first end to the connector tab of the propeller and lower housing unit protection subassembly adjacent the linear connector member secured thereto, and secured at a second end to the U-shaped portion of the clamp member adjacent the pivot pin member securing the linear connector member thereto.

* * * * *